US006588419B1

(12) United States Patent
Buezis et al.

(10) Patent No.: US 6,588,419 B1
(45) Date of Patent: Jul. 8, 2003

(54) FIREPLACE INSERT THERMALLY GENERATING ELECTRICAL POWER USEFUL FOR OPERATING A CIRCULATING FAN

(75) Inventors: James G. Buezis, Plymouth, MN (US); Stephen J. Kemp, Eagan, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/166,550

(22) Filed: Jun. 10, 2002

(51) Int. Cl.[7] ..... F24B 1/18; F24C 3/00

(52) U.S. Cl. ..... 126/500; 126/512; 126/531

(58) Field of Search ..... 126/500, 512, 126/521, 522, 523, 526, 531

(56) References Cited

U.S. PATENT DOCUMENTS 4,336,692 A * 6/1982 Ecker et al. ..... 62/82
4,512,329 A 4/1985 Sweet
4,942,863 A * 7/1990 Chou et al. ..... 126/110 E
5,495,829 A * 3/1996 Jayaraman et al. ..... 122/110
5,544,488 A * 8/1996 Reid ..... 62/3.7
5,610,366 A 3/1997 Fleurial et al.
5,747,728 A 5/1998 Fleurial et al.
5,769,943 A 6/1998 Fleurial et al.
6,019,098 A * 2/2000 Bass et al. ..... 126/344
6,037,536 A 3/2000 Fraas
6,257,871 B1 * 7/2001 Weiss et al. ..... 431/20
6,439,877 B1 * 8/2002 Weiss ..... 431/20

* cited by examiner

*Primary Examiner*—Alfred Basichas

(57) ABSTRACT

A fireplace appliance for warming room air without line electrical connection has a high efficiency thermoelectric generator having a heat-rejecting surface connected to a heat sink. The generator has a heat-receiving surface facing the site where a fireplace flame is to be located. In one embodiment the generator provides power to operate a fan that forces air through an air duct. The air duct has an inlet port receiving a flow of room air, and an outlet port. The heat sink is placed in the air duct where airflow generated by the fan moves across and cools the heat sink. The air heated by the heat sink flows to the room through the outlet port. One suitable material for the thermoelectric generator is a Bi—Te semiconductor. A number of options are shown that allow fan operation to commence properly while the appliance begins a cold start.

21 Claims, 2 Drawing Sheets

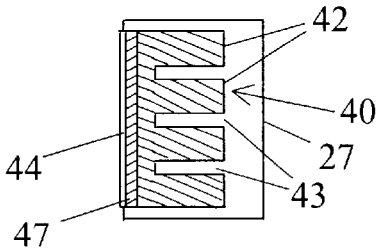
Fig. 2
Fig. 3
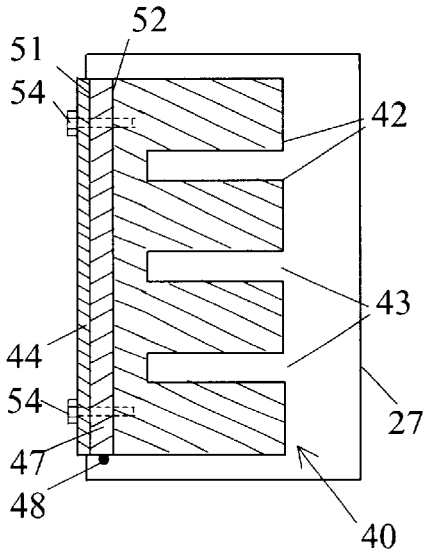
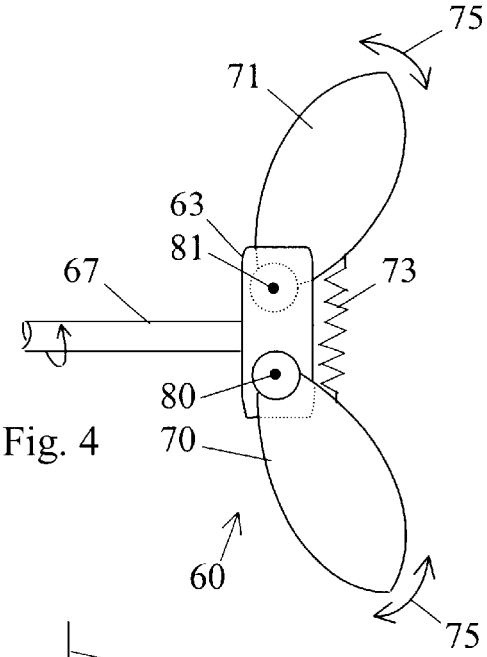
Fig. 4
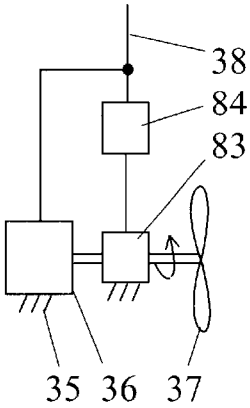
Fig. 5
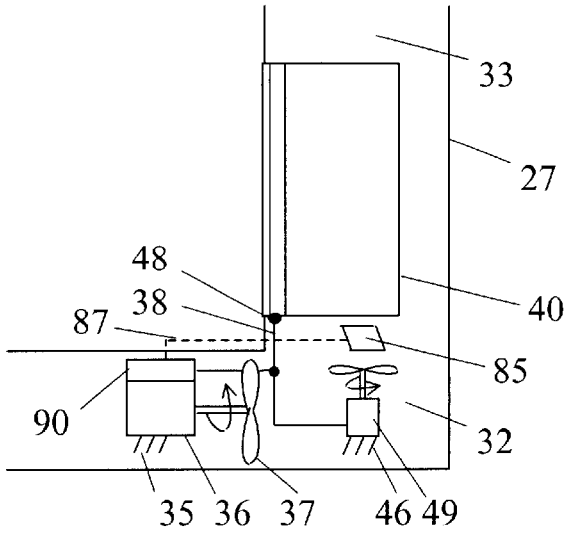
Fig. 6

FIREPLACE INSERT THERMALLY GENERATING ELECTRICAL POWER USEFUL FOR OPERATING A CIRCULATING FAN

BACKGROUND OF THE INVENTION

Fireplaces have been a part of permanent dwellings since such dwellings were first built. In the early years before central heating was developed, fireplaces were an important source of the heat that warmed these dwellings and their occupants. However, after central heating became available, the greater convenience and efficiency of central heating relegated fireplaces to an esthetic function for the most part.

One long-standing problem with fireplaces is the inconvenience and mess of burning wood. It is relatively difficult to start a wood fire. Once that has been done, it is necessary to continuously add further wood to maintain the fire. It is not easy to shut down a wood fire. Instead the occupant must allow it to burn itself out, during which time cold air can flow down the flue, cooling the room air. Then, after waiting for the ashes to completely cool which may take a day or more, the occupant must remove and discard the ashes. This last is a dirty and tedious job. Ashes are dusty, and the fine particles drift throughout the room during ashes removal.

For these reasons, gas-fueled fireplaces are becoming more and more popular. They are easy to start and stop, and they produce little or no soot and essentially no ash. An artificial log or two provide a wood fireplace ambiance, and a hidden burner directs a flow of gas to feed the flame and to form a combustion site within the fireplace.

More recently fireplace appliances or inserts have been developed that substantially improve fireplace efficiency. These appliances include a heat exchanger receiving heat from the combustion site for warming room air. A circulating fan forces room air through the heat exchanger. One significant disadvantage of most of these inserts is that they require line electrical power to operate the circulating fan. Thus, they are inoperable during power outages, when they're frequently needed most. Secondly, particularly during installation in existing fireplaces, running line power to a fireplace is expensive.

Recent developments have addressed this problem to some extent. For example, U.S. Pat. No. 6,037,536 (Fraas) shows a fireplace insert using a panel of photovoltaic devices to convert infrared radiation energy to electrical energy. This design has the potential to provide a substantial amount of power, and more than enough to operate a circulating fan. However, the overall design may not be well suited for heating room air. And the photovoltaic devices may be expensive and require frequent cleaning for good efficiency.

Accordingly, there are good reasons to seek a different technical approach when the aim is improve the ability of a fireplace to heat a room. Thermoelectric devices such as thermopiles have been available for many years, used for example for sensing presence of pilot flame in a burner. The pilot flame produced sufficient heat to produce a current allowing a solenoid to hold a gas valve open. However, until recently, thermopiles produced power measured in the hundreds of milliwatts at most, which is much less than needed to operate a fan for drawing air from a room for heating using fireplace combustion. Further, these thermopiles had cylindrical shapes not well suited for the aesthetics of a fireplace.

Recently more efficient thermoelectric devices have been developed that are formed as a plate or layer, hereafter referred to as a thermoelectric layer. The thermoelectric layer has a heat-receiving surface facing in a first direction and a heat-rejecting surface facing generally in a direction opposite to the heat-receiving surface. One such device designated as the HZ-2 thermoelectric module is currently available from Hi-Z Technology, Inc., 7606 Miramar Rd., San Diego, Calif. 92126-4210. The HZ-2 device has a bismuth-tellurium semiconductor layer (hereafter Bi—Te layer) and is about 1.15 in. (2.9 cm.) square and 0.2 in. (0.5 cm.) thick. The HZ-2 device provides over 2 watts of electrical power when its heat-receiving and heat-rejecting surfaces are held at a 200 C. temperature difference. A number of HZ-2 modules can be combined to provide more power. Further discussions of this technology are found in U.S. Pat. Nos. 5,769,943; 5,610,366; and 5,747,728.

BRIEF DESCRIPTION OF THE INVENTION

We have developed an appliance for efficiently heating room air from the heat of a flame having a combustion site within a fireplace. The appliance is to be placed within the fireplace cavity.

The appliance includes an airflow path having an inlet duct for receiving room air and an outlet duct through which this air returns to the room, and has a heat exchange duct between the inlet and outlet ducts. The inlet, heat exchange, and outlet ducts collectively define or form the airflow path.

A fan is mounted within the airflow path to force room air through the airflow path from the inlet duct to the outlet duct and through the heat exchange duct. A motor is mechanically connected to operate the fan.

A thermoelectric generator is mounted to receive heat from the flame and to provide electrical power at an electrical terminal. A heat sink is mounted in the heat exchange duct and in heat exchanging relationship with the thermoelectric generator.

Air flowing through the heat exchange duct is heated by the heat sink. The airflow removes heat from the heat sink, thereby holding the heat sink cool relative to the temperature of the thermoelectric generator where the heat from the flame is received from the combustion site.

One version of this invention includes an electrical connection between the thermoelectric generator's electrical terminal and the motor. The motor receives electrical power from the thermoelectric generator and operates the fan. The fan causes airflow through the heat exchange duct, which cools the heat sink by heating the air. The heated air flows back into the room, thereby warming the room.

A preferred version of the invention includes a thermoelectric generator having thermoelectric material with a heat-receiving surface for mounting adjacent to the combustion site and a heat-rejecting surface in heat-transferring relation with the heat sink.

The thermoelectric generator may include a heat-receiving plate having a first surface to be mounted facing the combustion site, and a second surface oppositely facing from the first surface and in heat-transferring contact with the thermoelectric material's heat-receiving surface. The heat sink is in heat-transferring contact with the heat-rejecting surface of the thermoelectric material.

One problem that a commercial embodiment must address is the startup dynamics. After the flame first occurs, there will be little heat gradient between the heat-receiving and heat-rejecting surfaces of the thermoelectric generator. Accordingly, little power will be generated. If the heat-rejecting surface temperature rises quickly as the heat-receiving surface warms, the thermoelectric generator will produce little or no power. In this case, the fan may fail to operate, with the result that no cooling airflow across the heat sink occurs. The situation may lead to temperature runaway for the heat sink, with the fan failing to ever operate.

We have developed a number of solutions to this problem. One of these solutions comprises using a heat sink having a large thermal mass. As the heat is applied to the thermoelectric generator's heat-receiving surface, the large thermal mass of the heat sink keeps the heat-rejecting surface of the thermoelectric generator sufficiently cool to allow the fan to begin operating. After the fan begins to operate, the airflow will function to maintain the heat-rejecting surface at a sufficiently low temperature.

A load-reducing feature in the fan may be combined with the high thermal mass heat sink solution, or may be employed alone. Such a feature can in one embodiment comprise feathering or folding fan blades that provide limited airflow while feathered. Such blades require little torque to rotate. As the motor speed builds, centrifugal force causes the fan blades to deploy in an extended position which forces increased airflow through the ducts.

An alternative load-reducing feature may be a clutch for connecting the fan to the motor. Still another type of load-reducing feature may be a small auxiliary fan suitable only for partially cooling the heat sink but that operates on a relatively small amount of power while power is removed from the large main fan. Once the heat-receiving surface of the thermoelectric generator has heated sufficiently, enough electrical power is available to operate the large fan.

BRIEF DESCRIPTION OF THE DRAWINGS

FIG. 2 is a cross sectional view of the heat sink shown in FIG. 1.

FIG. 3 is an enlarged view of the cross sectional view of the heat sink shown in FIG. 2.

FIG. 4 is a larger than scale view of a folding or feathering fan to function as a load-reducing feature for the embodiment of FIG. 1.

FIG. 5 is a block diagram of a clutch connecting the fan to the motor to serve as a load-reducing feature.

FIG. 6 is a diagrammatic view of a fan system using both auxiliary and main fans.

DESCRIPTION OF THE PREFERRED EMBODIMENTS

Figure 1:
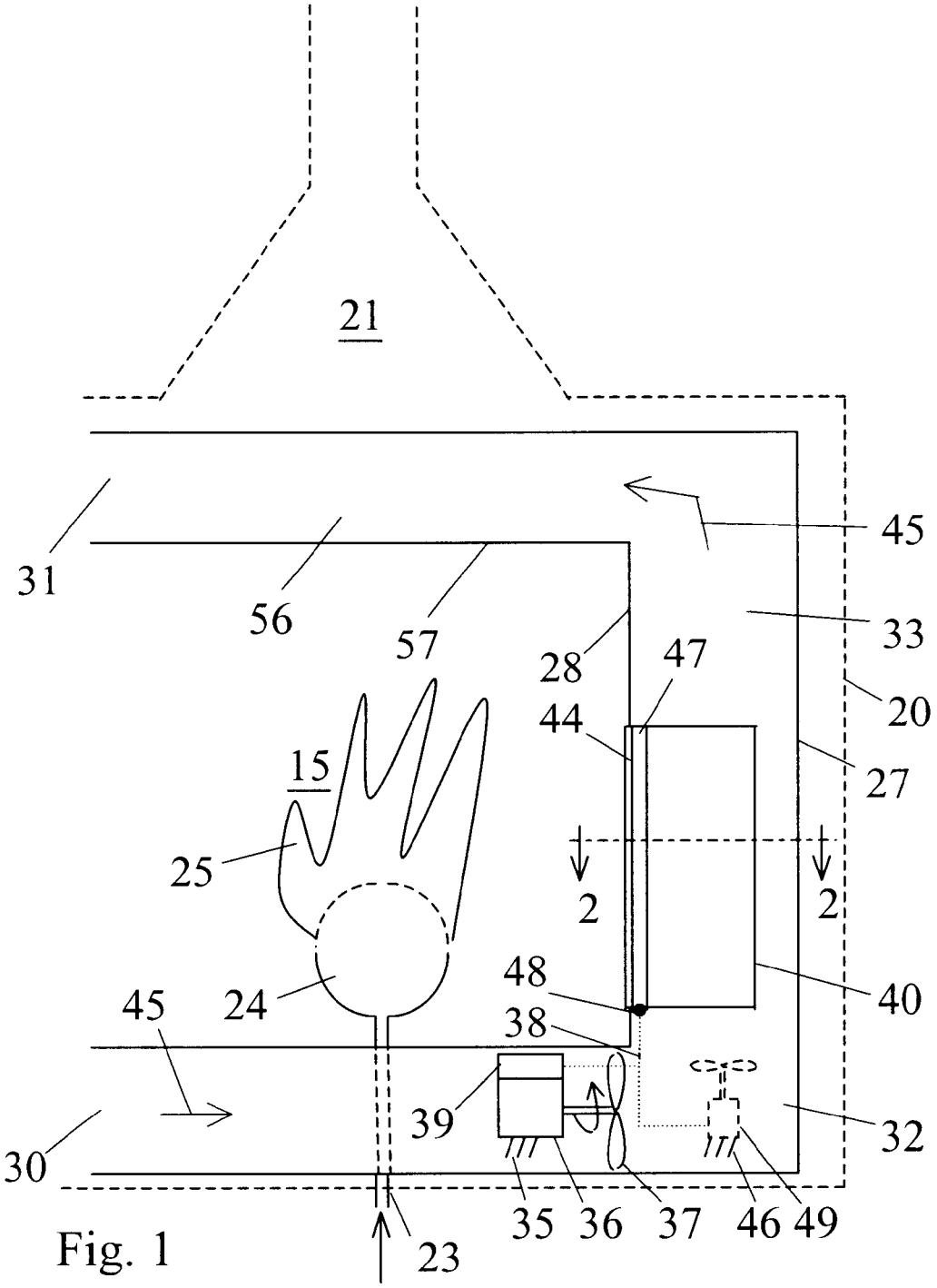
FIG. 1 is a diagrammatic side section outline view of one possible preferred embodiment of the invention, and includes load-reducing features for startup operation.

In the diagrammatic side section view of FIG. 1, a conventional fireplace 20 is shown in outline. Fireplace 20 has a combustion site 15 with a gas fireplace log 24 for supporting a flame 25. A gas pipe 23 provides fuel for log 24. In the conventional manner, log 24 simulates the appearance of a wood log. Log 24 has a series of holes through which gas from gas pipe 23 flows. A flue 21 conveys hot combustion gasses from the combustion site 15.

Room air is circulated through an air duct comprising an inlet port 30, a heat exchange path generally between 32 and 33, and an outlet port 31. Outlet port 31 of course allows combustion gasses to flow from combustion site 15 to flue 21. Walls 27 and 28 define the heat exchange path 32, 33. A motor 36 mounted on a symbolically shown bracket 35 drives a circulating fan 37. Motor 36 may be mounted at any convenient location within the air duct. Arrows 45 show the general direction of air circulation.

A heat sink 40 is mounted in or forms a part of wall 28 and projects into heat exchange path 32, 33. Referring next to FIGS. 2 and 3 as well as FIG. 1, heat sink 40 includes a plurality of fins or bars 42 that increase the exposed area available for convective heat transfer from heat sink 40 to adjacent airflow. In a typical design, there will be many more than the four fins 42 shown. The spaces or channels 43 between the individual fins 42 should preferably extend longitudinally in the direction of airflow in heat exchange path 32, 33. We prefer that heat sink 40 be made of cast aluminum. Aluminum is relatively light and cheap, and next to copper and silver, is the best of the metal heat conductors. Aluminum also has quite good specific heat capacity, and this will be seen to be a potentially important advantage.

A thermoelectric generator 47 converts heat produced by flame 25 into electrical power through both radiation and convection. FIG. 3 shows the arrangement by which thermoelectric generator 47 is attached to heat sink 40. Generator 47 has the general form of a plate or layer shown on edge in FIGS. 2 and 3. For convenience, we consider a generator 47 of this shape to comprise a thermoelectric layer. Generator 47 has a terminal 48 at which electrical power from generator 47 is provided to an electrical device. Generator 47 also has a heat-receiving surface 51 and a heat-rejecting surface 52, each of which is shown in FIG. 3 on edge as a line. Generator 47 is attached to heat sink 40 in some way that places heat-rejecting surface 52 in good thermal contact with heat sink 40.

We show a protective plate 44 in facing and adjacent relation to combustion site 15 for clamping generator 47 to heat sink 40, although other means such as heat-resisting adhesives may also be used for this purpose. Plate 44 is normally the preferred solution since its ruggedness will provide mechanical protection for generator 47. If plate 44 is made of aluminum, the thermal drop through plate 44 is minimal thereby leaving the efficiency of electrical generation relatively high. Further, we expect that surfaces facing combustion site 15 will become dirty over time. A dirty surface interposed between combustion site 15 and generator 47 may reduce the efficiency of electrical generation. A relatively thick (say 0.1 in. or 2.5 mm.) aluminum plate 44 provides mechanical protection against abrasion during cleaning.

Plate 44 will also reduce thermal shock when flame 25 is initiated. Plate 44 and generator 47 are held in place by cap screws 54 that thread into tapped holes in heat sink 40. Depending on the particular design and the mechanical strength of generator 47, screws 54 may tightly clamp plate 44, generator 47, and heat sink 40 to each other to form a good thermal contact, or may be tightened only sufficiently to hold plate 44, generator 47, and heat sink 40 all firmly in place.

Another suitable means to create a good thermal contact between the surfaces of generator 47 and the adjacent surfaces of plate 44 and heat sink 40 is to place silicone grease or other heat-conducting liquid between these two pairs of surfaces. Silicone grease has been used for decades in the electronics industry to aid heat transfer between electronic devices and heat sinks on which they are mounted. It is stable at high temperatures, is inexpensive and easy to apply, and conducts heat quite efficiently. Silicone grease creates good thermal contact without high flatness and smoothness on the surfaces involved, and hence may result in less costly manufacture. If silicone grease is used here, the manufacturer's specifications for application and clamping force must be observed to avoid both voids and forcing of the grease from the space between heat-rejecting surface 47 and heat sink 40.

While generator 47 is shown as a single plate or layer, it may be formed as a number of separate modules that are electrically connected together and to terminal 48. One advantage of such a structure is that by connecting the modules in series may provide higher output voltage which is often more compatible with existing designs available to use as motor 36. If a number of modules comprise generator 47, the use of plate 44 to clamp them into place is particularly convenient.

The Background section refers to the HZ-2 Bi—Te thermoelectric generator module. The HZ-2 module or a larger variation of it is suitable for use as generator 47.

Conductor 38 carries electrical power provided at terminal 48 to a motor controller 39. Controller 39 monitors the power level at terminal 48 and completes the connection between motor 36 and terminal 48 when the power is sufficient to operate fan 37. Fan 37 draws air from the room through inlet duct 30 and forces this air through heat exchanger path 32, 33. Air then returns to the room through outlet duct 31, all as shown by arrows 45. Air flows through channels 43 of heat sink 40, thereby increasing its temperature and at the same time cooling heat sink 40. As long as fan 37 continues to rotate at a normal speed, air flow through heat exchanger path 32, 33 continues to cool heat exchanger 40, thereby maintaining a temperature difference between the sides 51 and 52 (FIG. 3) of heat exchanger 40.

If desired, the air duct may include a heat exchanger portion 56 for carrying airflow to outlet port 31. An external surface 57 of the heat exchanger portion 56 is positioned to allow the combustion gasses rising to flow into flue 21 to also flow across the external surface 57. The hot combustion gasses further heat the room air flowing through the heat exchanger portion 56 thereby providing hotter room air to port 31. The outlet duct heat exchanger should not cool the combustion gasses to the extent of affecting natural convective flow of combustion gasses through flue 21. Since these flue gasses may sometimes be toxic, backflow into occupied quarters is undesirable.

One problem we attempt to solve with our invention is that of insufficient power to operate motor 36 during the time after flame 25 is first initiated. When flame is first established, the temperature drop across generator 47 is very small, resulting in little power at terminal 48 preventing motor 36 operation. As flame 25 begins to heat plate 44, the temperature at heat-receiving surface 51 increases. It is possible that a substantial amount of heat generated during this startup phase can pass through generator 47 to heat-rejecting surface 52. This has the potential to warm surface 52 and the adjacent volume of heat sink 40, preventing a temperature drop across generator 47 adequate to operate motor 36. If motor 36 cannot ever start operation, then heat sink 40 will not ever be sufficiently cool to establish a temperature drop allowing motor 36 operation.

We have a number of solutions for this problem. A first, and one compatible with other solutions to be shown, is to provide a heat sink 40 whose thermal mass is much larger than that of plate 44 and of generator 47. A heat sink 40 whose mass near to heat-rejecting surface 52 is several times larger than the total mass of plate 44 will warm only slightly over the first few minutes after flame 25 startup. During this time, a temperature gradient across generation 47 that will provide sufficient power to operate motor 36 and fan 37 will become established.

In some situations a difference in mass between plate 44 and heat sink 47 may not be adequate to begin motor 35 operation during startup. One solution is an auxiliary motor-fan unit 49 mounted on bracket 46 to provide an air stream across heat sink 40 when operating. Motor-fan unit 49 should be capable of operating on substantially smaller power than motor 36 and fan 37 and yet provide adequate cooling for heat sink 40 until sufficient power to operate motor 36 and fan 37 is available. Controller 39 operated by power from generator 47 should disconnect motor 36 from generator 47 until power output from generator 47 is sufficient to operate motor 36.

The operation of controller 39 may be electronic and depend on the voltage produced at terminal 48 to indicate the power available from generator 47. Many types of thermopiles suitable to use as generator 47 produce a voltage across a suitably chosen resistor that accurately indicates the power available at any given time from generator 47. In that case, controller 39 may monitor the voltage on conductor 38 and connect motor 36 only when sufficient power is available. We will disclose in connection with FIG. 6 another means to monitor power output from generator 47 while relying on an auxiliary motor-fan unit 49.

FIG. 4 shows version of apparatus allowing motor 36 to start up with reduced power. Motor 36 has a shaft 67 carrying a folding or feathering fan blade unit 60, shown partly feathered in FIG. 4, and significantly enlarged as well relative to the view of FIG. 1. Blade unit 60 includes a pair of blades 70 and 71, each of which is attached by a pivot pin 80 or 81 to a bracket unit 63 carried on the end of shaft 67. In this embodiment, the axes of pins 80 and 81 are transverse to the axis of shaft 67. Arrows 75 indicate the articulation that blades 70 and 71 can undergo while moving from feathered or folded to fully extended. A mechanical spring 73 urges the blades 70 and 71 into a folded position where the rotational inertia and air resistance is minimized. Blades 70 and 71 can rotate against spring 73 force into fully extended positions.

In the folded position, blades 70 and 71 may have a shape that propels a small amount of air through the heat exchange path 32, 33 and past heat sink 40. Such a level of airflow must be adequate to cool heat sink 40 to a temperature that results in generation of adequate electrical power by generator 47 to operate motor 36 at a relatively low speed. Little aerodynamic drag from blades 70 and 71 is present because of the small active area of blades 70 and 71. With increased electrical power applied to motor 36, speed of shaft 67 increases. When shaft 67 speed reaches a predetermined level, centrifugal force increases to a level that causes blades 70 and 71 to begin to unfold and extend against the force of spring 73. As blades 70 and 71 unfold, the volume rate of air flow through heat exchange path 32 increases to a level that will add measurable heat to the room as well as more efficiently cool heat sink 40.

FIG. 5 shows yet another version of apparatus allowing motor 36 to start with less than normal power. Power from generator 47 is carried on conductor 38 to a clutch controller 84. Power is also carried directly to motor 36. Power from generator 47 must be adequate to operate controller 84 and a magnetic clutch 83 at some point before motor 36 can drive fan 37. Clutch 83 adjusts the amount of torque transmitted from motor 36 to fan 37 responsive to a clutch control signal from controller 84 to prevent motor 36 from stalling. Recall that drag torque for fan 37 increases substantially as fan 37 speed increases. Controller 84 must control clutch 83 to transmit torque at a level that avoids stalling motor 36.

Controller 84 measures the amount of power available from generator 47. Generator 47 voltage is an indication of the level of power available at any instant from generator 47. Controller 84 can monitor generator 47 voltage and when the voltage level indicates available power is above a predetermined level adequate to operate fan 37 at low speed, controller 80 provides a clutch control signal engaging the clutch 83 to transmit a sufficient level of torque to slowly rotate fan 37. Fans generally, have very little aerodynamic resistance at low speed, so motor 36 can slowly rotate fan 37. As airflow from fan 37 helps to keep heat sink 40 cool and plate 44 warms further, power from generator 47 to motor 36 increases. When power from generator 47 increases to a level sufficient to run fan 37 at full speed, controller 84 applies a clutch control signal sufficient to lock up clutch 83.

In this way, motor 36 can be operated at the speed near its peak torque given the power available. If fan 37 were to be directly connected to motor 36, fan 37 torque at that speed may be larger than the torque available. This will stall motor 36, preventing any airflow generated by fan 37 rotation. As air continues to flow across heat sink 40, and plate 44 continues to heat from flame 25, the temperature differential across generator 47 will continue to increase. This increases power available from generator 47. When available motor torque is adequate to rotate fan 37 with clutch 83 locked up, controller 80 provides a clutch control signal that locks clutch 83.

FIG. 6 shows one version of a system using an auxiliary motor-fan unit 49. Unit 49 must be chosen to operate on relatively low power, and provide sufficient airflow to cool heat sink 40 while the temperature differential across generator 47 is established. Unit 49 must also increase speed and consequently, airflow as well, with increasing power from generator 47.

A sail or paddle 85 is mounted in the air stream generated by unit 49. A mechanical linkage 87 cooperates with sail 85 to operate a motor switch 90 when airflow sensed by sail 85 reaches a predetermined level. Switch 90 controls flow of electrical power from conductor 38 and terminal 48 to motor 36. This predetermined airflow level correlates with the power available from generator 47. When switch 90 closes due to the level of airflow sensed by sail 85, motor 36 begins operation. In this way, motor-fan unit 49 in cooperation with sail 85 and linkage 87 can sense the power available from generator 47.

What is claimed is:

1. A fireplace appliance for warming room air with heat from a flame having a combustion site within the fireplace, comprising:

a) an air duct having an inlet port for receiving room air and an outlet port for returning room air, and having a heat exchange path between the inlet and outlet ports;

b) a fan mounted within the air duct to force flow of room air within the duct from the inlet port to the outlet port and through the heat exchange path;

c) a motor mechanically connected to the fan;

d) a thermoelectric generator mounted to receive heat from the flame and to provide electrical power at an electrical terminal; and e) a heat sink mounted in the heat exchange path and in heat exchanging relationship with the thermoelectric generator.

2. The appliance of claim 1, including an electrical connection between the thermoelectric generator's electrical terminal and the motor.

3. The appliance of claim 2, wherein the thermoelectric generator includes thermoelectric material having a heat-receiving surface for mounting adjacent to the combustion site and a heat-rejecting surface in heat-transferring relation with the heat sink.

4. The appliance of claim 3, wherein the thermoelectric material is formed in a layer, said appliance including: a heat-receiving plate having a first surface to be mounted facing the combustion site, and a second surface oppositely facing from the first surface and in heat-transferring contact with the thermoelectric material's heat-receiving surface, wherein the heat sink is in heat-transferring contact with the thermoelectric material's heat-rejecting surface.

5. The appliance of claim 4, wherein the thermoelectric material comprises bismuth and tellurium.

6. The appliance of claim 4, wherein the heat sink mass is several times larger than the total mass of the heat receiving plate to thereby provide sufficient power to operate the motor after flame start up.

7. The appliance of claim 1, wherein the heat exchange duct of the airflow path is vertically oriented and adjacent to the combustion site.

8. The appliance of claim 7, wherein the heat sink is mounted to project into the heat exchange duct and the thermoelectric generator is mounted in heat-transferring contact with the heat sink.

9. The appliance of claim 8, wherein the thermoelectric generator includes thermoelectric material having a heat-rejecting surface, and wherein the heat sink is in heat-transferring contact with the thermoelectric material's heat-rejecting surface.

10. The appliance of claim 9, wherein the heat sink includes a plurality of fins mounted in the heat exchange path.

11. The appliance of claim 10, wherein the thermoelectric material comprises a layer having a heat-receiving surface, said appliance including a heat-receiving plate having a first surface adjacent to and facing the combustion site, and a second surface oppositely facing from the first surface and in heat-transferring contact with the thermoelectric material's heat-receiving surface.

12. The appliance of claim 11, wherein the heat sink has a thermal mass, and wherein the heat-receiving plate has a thermal mass substantially smaller than the thermal mass of the heat sink.

13. The appliance of claim 1, wherein the fan includes a shaft mounted for rotation and on which is mounted a blade, said shaft receiving torque from the motor, said blade further including a load-reducing feature, said load-reducing feature active responsive to the speed of shaft rotation falling below a preselected value.

14. The appliance of claim 13, wherein the load-reducing feature comprises a blade-folding mechanism having a blade pivot connecting the blade to the shaft.

15. The appliance of claim 14, wherein the blade pivot has an axis substantially transverse to the axis of the shaft, and wherein the blade-folding mechanism includes a spring urging the blade into a folded position.

16. The appliance of claim 14, wherein the blade-folding mechanism includes a spring urging the blade into a folded position.

17. The appliance of claim 2, including a load-reducing feature comprising a low-power motor and fan unit mounted in the airflow path and receiving operating power from the thermoelectric generator, and generating an air stream flowing across the heat sink.

18. The applicant of claim 17, including a sail mounted in the air stream generated by the low power motor and fan unit, a motor switch controlling flow of electrical power from the generator to the motor, and a mechanical linkage cooperating with the sail to operate the motor switch when air flow past the sail reaches a predetermined level.

19. The appliance of claim 1, wherein the fan is carried on a fan shaft and wherein the load-reducing feature comprises an electrically controlled clutch connecting the fan shaft to the motor for rotation, and a clutch control unit sensing the power available from the thermoelectric generator, and deactivating the magnetic clutch at least partially responsive to power available from the thermoelectric generator falling below a predetermined value.

20. The appliance of claim 1 wherein the flame produces hot combustion gasses, and wherein the air duct includes a heat exchanger portion through which flows room air, said heat exchanger portion having an exterior surface, said heat exchanger portion positioned to allow combustion gasses from the flame to flow across the exterior surface.

21. The appliance of claim 20, wherein the air duct's heat exchanger portion is mounted downstream with respect to the flow of room air, from the heat sink.

* * * * *